US008372172B2

(12) United States Patent
Murakami et al.

(10) Patent No.: US 8,372,172 B2
(45) Date of Patent: Feb. 12, 2013

(54) GAS-LIQUID SEPARATOR AND AIR CONDITIONER EQUIPPED WITH THE SAME

(75) Inventors: Hiroki Murakami, Tokyo (JP); Hironori Nagai, Tokyo (JP); Tadashi Saito, Tokyo (JP); Hiroaki Makino, Tokyo (JP); Yasuhide Hayamaru, Tokyo (JP); Kazuhide Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 439 days.

(21) Appl. No.: 12/666,313

(22) PCT Filed: Jun. 16, 2008

(86) PCT No.: PCT/JP2008/060978

§ 371 (c)(1),
(2), (4) Date: Apr. 21, 2010

(87) PCT Pub. No.: WO2009/001701

PCT Pub. Date: Dec. 31, 2008

(65) Prior Publication Data

US 2010/0199716 A1 Aug. 12, 2010

(30) Foreign Application Priority Data

Jun. 25, 2007 (JP) ..... 2007-166343
Dec. 12, 2007 (JP) ..... 2007-320581

(51) Int. Cl.
*B01D 50/00* (2006.01)

(52) U.S. Cl. ..... 55/319; 55/459.1; 55/459.5; 55/447; 55/449; 60/512; 60/470; 60/471

(58) Field of Classification Search ..... 55/319, 55/459.1, 459.5, 447, 449; 60/512, 470, 60/471

See application file for complete search history.

(56) References Cited

U.S. PATENT DOCUMENTS

| | | | | |
|---|---|---|---|---|
| 5,347,817 | A * | 9/1994 | Kim | 62/471 |
| 6,574,986 | B2 | 6/2003 | Morimoto et al. | |
| 2008/0177019 | A1 * | 7/2008 | Salmon et al. | 526/352.2 |

FOREIGN PATENT DOCUMENTS

| | | |
|---|---|---|
| JP | 46 34632 | 11/1971 |
| JP | 53 80855 | 7/1978 |
| JP | 55 31491 | 8/1980 |
| JP | 61 55676 | 4/1986 |
| JP | 62 62175 | 4/1987 |
| JP | 63 25467 | 2/1988 |

(Continued)

*Primary Examiner* — Jason M Greene
*Assistant Examiner* — Dung H Bui
(74) *Attorney, Agent, or Firm* — Oblon, Spivak, McClelland, Maier & Neustadt, L.L.P.

(57) ABSTRACT

To improve the separation efficiency of a gas-liquid separator in the gas-liquid separator and an air conditioner, the gas-liquid separator having a vessel with an inlet pipe and an outlet pipe is arranged such that an exit end section of the inlet pipe is formed to be closed or to have a gap, an expanded end section having a width greater than the diameter of that portion of the inlet pipe which crosses a container of the gas-liquid separator is provided, and that a lateral hole is formed in a side face of the expanded end section. Refrigerant vapor and refrigerant liquid are efficiently separated from each other at the expanded end section, and this improves separation efficiency of the gas-liquid separator.

15 Claims, 10 Drawing Sheets

FOREIGN PATENT DOCUMENTS

| | | |
|---|---|---|
| JP | 2 114881 | 9/1990 |
| JP | 7 83544 | 3/1995 |
| JP | 10 30863 | 2/1998 |
| JP | 10 78275 | 3/1998 |
| JP | 2003 4343 | 1/2003 |
| JP | 3593594 | 11/2004 |

* cited by examiner

C-C

B-B

B-B

A-A

B-B

B-B

D-D

GAS-LIQUID SEPARATOR AND AIR CONDITIONER EQUIPPED WITH THE SAME

TECHNICAL FIELD

This invention relates to a gas-liquid separator and an air conditioner equipped with the same.

BACKGROUND ART

In a refrigerant cycle, a refrigerant liquid condensed in the condenser is depressurized by an expansion valve to become a gas-liquid two-phase state fluid in which the refrigerant vapor and the refrigerant liquid is mixed and flows into an evaporator. When the refrigerant flows into the evaporator in the gas-liquid two phase state, the pressure loss of the refrigerant when passing through the evaporator is large, resulting in the decrease in the energy efficiency of the air conditioner.

Therefore, the energy efficiency of the air conditioner can be improved by separating the refrigerant into the refrigerant vapor and the refrigerant liquid through the use of a gas-liquid separator before the refrigerant flows into the evaporator so that only the refrigerant liquid flows through the evaporator to decrease the pressure loss generated when the refrigerant passes through the evaporator.

In the conventional gas-liquid separator, the inlet pipe and the outlet pipe are disposed in the upper portion of the vessel, the diameter of the inlet pipe is made smaller toward the lower end of the inlet pipe, and a discharge hole is provided in a side face of the inlet pipe, thus manufacturing time is shortened as compared to the arrangement in which the inlet pipe is mounted to the side face of the vessel (see Patent Document 1, for example).

Patent Document 1: Japanese Patent No. 3,593,594

DISCLOSURE OF INVENTION

Problems to be Solved by the Invention

In such the gas-liquid separator, since the diameter of the inlet pipe is made smaller toward the lower end, in a situation of a circulating flow of the gas-liquid two phase in which the refrigerant liquid flows on the wall surface of the inlet pipe and the refrigerant vapor flows through the center of the inlet pipe, the liquid film thickness of the refrigerant liquid is large and the large amount of the refrigerant liquid is discharged from the flow-out hole provided in the side face of the inlet pipe, thus decreasing the separation efficiency. Also the large amount of the refrigerant liquid cannot be stored at the lower end portion of the inlet pipe, so that the refrigerant liquid flows out from the flow-out hole, resulting in a significant decrease in the separation efficiency.

Accordingly, the object of the present invention is to provide a gas-liquid separator of a high separation efficiency and to provide an air conditioner having installed with such the gas-liquid separator Measure for Solving the Problems A gas-liquid separator according to the present invention has a vessel with an inlet pipe and an outlet pipe, and an exit end section of said inlet pipe is formed to be closed or to have a gap, an expanded end section having a width greater than the diameter of that portion of said inlet pipe which crosses the vessel of the gas-liquid separator is provided, and a lateral hole is formed in a side face of said expanded end section.

Advantageous Results

According to the present invention, by providing an expanded end section having a width greater than the diameter of that portion of the inlet pipe which crosses the vessel of the gas-liquid separator, a large diameter lateral hole can be formed in a side face of the expanded end section, and the number of the lateral holes can be made small to reduce the manufacturing cost.

BEST MODE FOR CARRYING OUT THE INVENTION

The embodiments of the present invention will now be described.

Embodiment 1

Figure 1:
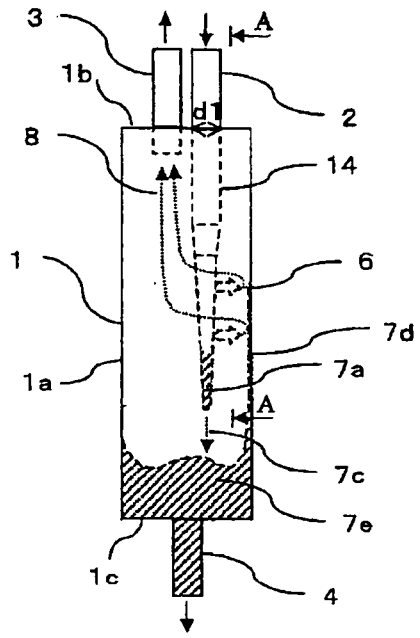
FIG. 1 is a front view of the gas-liquid separator of the present invention. (Embodiment 1)

FIG. 1 is a front view showing a gas-liquid separator according to embodiment 1 of the present invention. The gas-liquid separator comprises a vessel 1 including a cylindrical side wall 1*a*, a top wall 1*b* and a bottom wall 1*c*, an inlet pipe 2 mounted to and penetrated through the top wall 1*b*, and an upper outlet pipe 3 mounted to the top wall 1*b* in parallel to the inlet pipe 2, and a lower outlet pipe 4 mounted to the bottom wall 1*c* of the vessel 1. The vessel 1 is for achieving gas-liquid separation of a gas-liquid mixture fluid.

Figure 2:
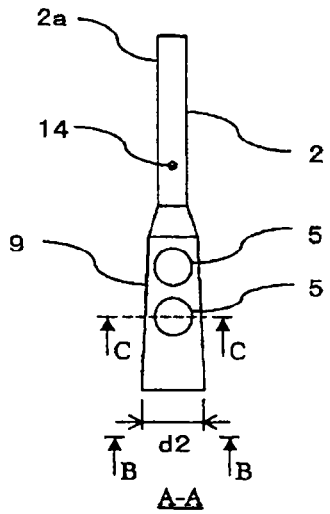
FIG. 2 is a side view taken along line A-A of FIG. 1 showing only the inlet pipe of the gas-liquid separator of FIG. 1. (Embodiment 1)
Figure 4:
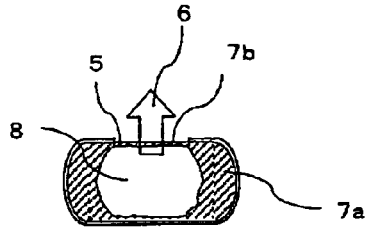
FIG. 4 is a sectional view of the inlet pipe of FIG. 2 taken along the line C-C. (Embodiment 1)

FIG. 2 is a side view showing only the inlet pipe 2 as seen along the line A-A of FIG. 1. The inlet pipe 2 is connected at one end to an external circuit and at the other end comprises a connecting pipe 2*a* of a circular cross-section hermetically penetrating through the top wall 1*b* of the vessel 1 and an expanded end portion 9 connected to the other end of the connecting pipe 2*a* and having a cross-section of a flat elongated shape as shown in FIG. 4. The expanded end portion 9 is provided in a side face including a longer side of the flat elongated cross-section with lateral holes 5 having a width (diameter) larger than the diameter d1 of the connecting pipe 2*a*. The expanded end portion 9 can be formed by expanding the inlet pipe 2 in a flat shape. The width d2 of the expanded end portion 9 is greater than the diameter d1 of the inlet pipe 2 at the portion crossing or penetrating the vessel 1 of the gas-liquid separator. Also, the expanded end portion 9 is arranged so that the flow direction of the refrigerant (arrow 6) from the lateral holes 5 is substantially perpendicular to the side wall 1*a* of the vessel 1. Also, a small hole 14 is provided in the side face of the inlet pipe 2 at the upstream of the lateral holes 5 or in the connecting pipe 2*a* in this embodiment.

The diameter d1 of the connecting pipe 2*a* is the diameter of the connecting pipe 2 at the portion crossing or penetrating the vessel 1. The width d2 of the expanded end portion 9 is made greater than the diameter d1 of the connecting pipe 2*a* at least at the position where the lateral holes 5 are provided. Also, the width of the lateral holes 5 is preferably equal to or greater than the diameter d1 of the connecting pipe 2*a*. In the illustrated embodiment, the width (diameter) of the lateral holes 5 is slightly larger than the diameter d1 of the connecting pipe 2*a*, and the width d2 of the expanded end portion 9 having a flat portion in which the large lateral holes 5 are formed is made about two times greater than the diameter d1 of the connecting pipe 2*a*.

Figure 3:
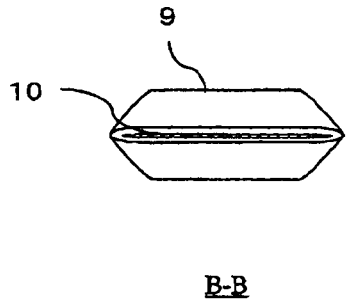
FIG. 3 is a bottom view of the inlet pipe of FIG. 2 as seen in the direction of arrow B. (Embodiment 1)

FIG. 3 is a bottom view showing the configuration of the expanded end portion 9 as viewed along the line B-B of FIG. 2. The expanded end portion 9 is provided at its bottom face with an elongated lower hole 10 having a gap of a few millimeters. The lower hole 10 may be formed by pressing the bottom end of the expanded end portion 9, for example.

FIG. 4 is a sectional view taken along the line C-C of FIG. 2 and showing the refrigerant flowing through the expanded end portion 9.

The description will be made in terms of the operation of the embodiment 1. During the cooling operation, the refrigerant flows in the inlet pipe 2 as a mixture of the refrigerant vapor and the refrigerant liquid in a gas-liquid two phase state and into the vessel 1 to further flows toward the expanded end portion 9. At this time, since the cross section of the expanded end portion 9 is a flat elongated configuration, the liquid film of the refrigerant liquid 7*a* on the surface including the shorter side of the flat elongated cross-sectional shape is thick and the liquid film of the refrigerant liquid 7*b* on the surface including the longer side is thinner. Therefore, even when the refrigerant liquid 8 is discharged from the lateral hole 5 disposed in the side face of the expanded end portion 9, only a small amount of the refrigerant liquid 7*b* is discharged.

The refrigerant liquid 7*b* discharged from the lateral holes 5 impinges against the side wall 1*a* of the vessel 1 and attached thereon to become refrigerant liquid 7*d* attached thereon and then, being separated from the refrigerant vapor 8, flows downward by the gravity along the side wall 1*a* of the vessel 1 to be stored in the bottom portion of the vessel 1 as refrigerant liquid 7*e*. Also, the refrigerant vapor 8 flows out from the vessel 1 through the upper outlet pipe 3.

On the other hand, the refrigerant liquid 7*a* not discharged from the lateral holes 5 and flows to the lower portion of the expanded end portion 9 is stored in the bottom of the expanded end portion 9 and flows out downwardly as refrigerant liquid 7*c* from the lower hole 10, and the refrigerant liquid 7*c* and the refrigerant liquid 7*d* join with the refrigerant liquid 7*e* accumulated in the bottom of the vessel 1 to flows out of the vessel 1 via the lower outlet pipe 4.

Thus, the gas-liquid separator comprises the vessel 1 for gas-liquid separation of the gas-liquid mixture fluid, the inlet pipe 2 including the connecting pipe 2*a* penetrating into the vessel 1 and the expanded end portion 9 connected to the inner end of the connecting pipe 2*a* for changing the flow direction of the gas-liquid mixture fluid, and the outlet pipe 3 penetrating into and extending from the vessel 1, the width dimension of the expanded end portion 9 being larger than the diameter of the connecting pipe 2*a* and the lateral holes 5 are being provided in the side face of the expanded end portion 9.

During the heating operation, the refrigerant flows through the refrigerant pipes in the opposite direction, the refrigerant liquid in the supercooled state condensed in the condenser flowing in the liquid state from the lower outlet pipe 4 into the vessel 1 and flowing out from the inlet pipe 2. At this time, the refrigerant circuit connected to the upper outlet pipe 3 is shut off by an electromagnetic valve or the like. In the vessel 1, an excess amount of refrigerant liquid is stored and, when the refrigerator oil is not soluble to the refrigerant, the refrigerator oil accumulates on the refrigerant liquid, so that the refrigerator oil flows out of the vessel 1 via the small hole 14 into the refrigerant circuit to return to the compressor.

Thus, since the refrigerant passing through the expanded end portion 9 becomes a thin liquid film of the refrigerant liquid 7*b* on the surface including the longer side of the flat elongated cross section, the amount of refrigerant liquid 7*b* discharged from the lateral holes 5 decreases and the refrigerant liquid 7*c* discharged from the lower hole 10 increases, so that the refrigerant vapor 8 and the refrigerant liquid 7*c* can be efficiently separated, resulting in the improved separation efficiency of the gas-liquid separator.

Also, the width d2 of the expanded end portion 9 is larger than the diameter d1 of the inlet pipe 2 at the portion at which the inlet pipe 2 penetrates through the vessel 1 of the gas-liquid separator and a large amount of refrigerant 7*a* can be stored in the lower portion of the expanded end portion 9, so that, even when the amount of refrigeration liquid flowing into the inlet pipe 2 is increased, the amount of the refrigerant liquid 7*a* discharged from the lateral holes 5 can be made small, enabling the further improvement in the separation efficiency.

Also, the provision of the expanded end portion 9 having a flat elongated cross-section at the lower end of the inlet pipe 2 permits the lateral holes 5 of a large diameter to be formed in the face that is the longer side of the flat elongated cross sectional shape, so that the pressure loss and the refrigerant noise when the refrigerant is discharged from the lateral holes 5 can be decreased.

Also, the number of the lateral holes 5 can be made small, so that the machining cost can be decreased. Also, the inlet pipe can be made shorter to realize the miniaturization of the vessel and the reduction of the material cost.

Also, the expanded end portion 9 is arranged such that the flow direction (arrow 6) of the refrigerant discharged from the lateral holes 5 is substantially perpendicular to the inner wall of the vessel 1, so that the discharged refrigerant liquid 7*b* immediately impinges against the side wall 1*a* of the vessel 1 to become the refrigerant liquid 7*d*, enabling the more efficient separation of the refrigerant vapor 8 and the refrigerant liquid 7*b*, resulting in a further improved separation efficiency.

While the expanded end portion 9 is formed by expanding the inlet pipe 2 in the embodiment 1, a separate expanding end portion 9 may be brazed to the inlet pipe 2.

Also, while the expanded end portion 9 is explained as having a cross section of a flat elongated shape, the cross section may be of an oval shape as long as the width d2 of the expanded end portion 9 is larger than the diameter d1 of the inlet pipe at the portion crossing or penetrating into the vessel of the gas-liquid separator.

Also, while two lateral holes 5 are shown, the lateral holes may be one or more and the diameter of the holes may be discretionary. When two or more lateral holes are to be provided, the hole diameter may be made the same, whereby only one kind of the tool may be used for forming the holes and the machining costs can be decreased.

Figure 5:
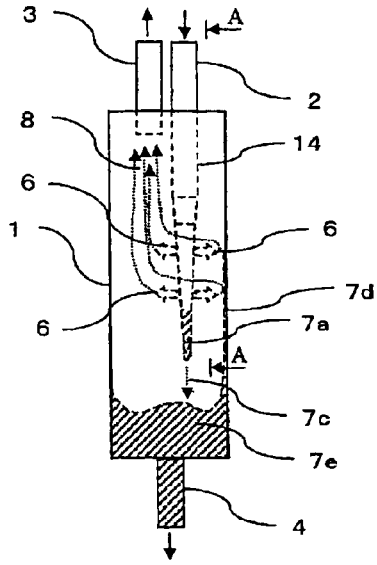
FIG. 5 is a front view showing a modified example of the gas-liquid separator of the present invention. (Embodiment 1)

Also, as shown in FIG. 5, the lateral holes 5 may be provided in the both surfaces including the longer side of the flat and elongated cross section of the expanded end portion 9. In this case, while the separation efficiency is slightly decreased because the distance across which the refrigerant liquid 7*b* discharged from the lateral hole 5 on the side remote from the side wall 1*a* of the vessel 1 reaches to the side wall 1*a* of the vessel is longer, the speed of the refrigerant discharged from the lateral hole 5 can be made lower, so that the pressure loss and the refrigerant noise can be further decreased and that the downsizing of the vessel and reduction of the material costs can be possible.

Figure 6:
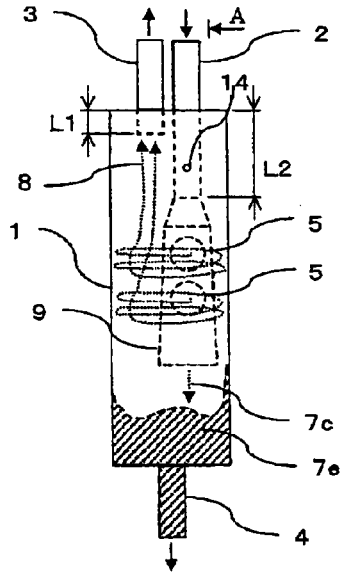
FIG. 6 is a front view showing another modified example of the gas-liquid separator of the present invention. (Embodiment 1)

Also, as shown in FIG. 6, the lateral holes 5 may be formed so that the discharge direction (arrow 6) of the refrigerant is substantially tangential to the side wall of the vessel 1. In this case, the refrigerant vapor 8 discharged from the lateral holes swirls and the refrigerant liquid 7*b* is separated by the centrifugal force, resulting in a further improvement in the separation efficiency.

Further, as shown in FIG. 6, by making the insertion length L2 to the expanded end portion 9 of the inlet pipe 2 greater than the insertion length L1 of the outlet pipe 3, the interference between the outlet pipe 3 and the expanded end portion 9 can be prevented, thus permitting the width d2 of the expanded end portion 9 to be further increased. This allows the diameter of the lateral holes 5 to be further larger to realize the reduction of the pressure loss and the refrigerant noise, the downsizing of the vessel, the reduction of the material cost and the improvement in the separation efficiency.

Also, since the small hole 14 is provided in the inlet pipe 2, the refrigerator oil accumulated in the vessel 1 during the heating operation can be returned to the compressor, so that the lubrication of the compressor can be improved. Also, by disposing the small hole 14 and the lateral holes 15 in the same side face of the input pipe 2, there is no need to change the position of the work piece during the hole forming, further reducing the manufacturing cost.

Also, the lower hole 10 having a gap of a few millimeters disposed in the lower side of the inlet pipe is provided by the pressing, the hole forming is not necessary, decreasing the machining cost. As for the lower hole 10, its opening area should be sufficiently small to prevent the refrigerant vapor 8 from being discharged from the lower hole 10 and it should be disposed on the downstream side of the lateral holes 5.

Figure 7:
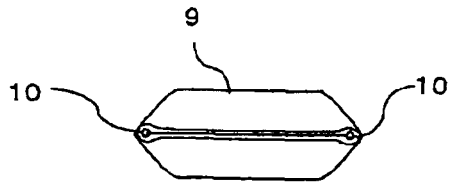
FIG. 7 is a bottom view showing a modified example of the inlet pipe of the gas-liquid separator of the present invention. (Embodiment 1)
Figure 8:
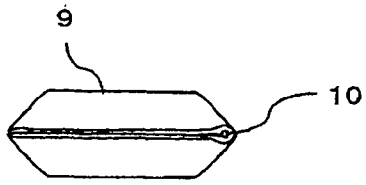
FIG. 8 is a bottom view showing another modified example of the inlet pipe of the gas-liquid separator of the present invention. (Embodiment 1)

As shown in FIG. 7, the lower hole 10 may be disposed at each side of the lower end of the expanded end portion 9, for example, and, as shown in FIG. 8, the lower hole 10 may be disposed at one end of the lower end of the expanded end portion 9 by pressure bonding the outlet end of the expanded end portion 9 from the center to one end. This eliminate the need for the separate hole forming for providing the lower hole 10 in the outlet end portion of the expanded end portion 9, enabling the machining cost to be decreased.

Figure 9:
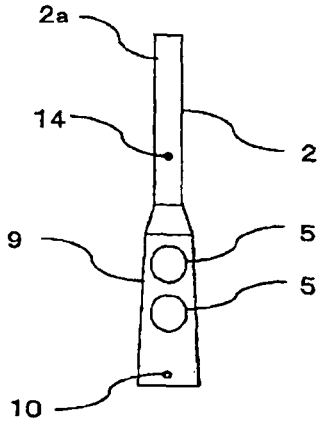
FIG. 9 is a side view showing a modified example of the inlet pipe of the gas-liquid separator of the present invention. (Embodiment 1)

Further, as shown in FIG. 9, the outlet end portion of the expanded end portion 9 may be completely sealed and the lower hole 10 may be hole-formed in the side face of the expanded end portion 9 at a position downstream of the lateral holes 5. In this case, the sealing machining of the outlet end portion of the expanded end portion 9 is easy and, since the lower hole 10 is formed by the hole-forming, the hole can be precisely dimensioned, resulting in the improvement in the separation efficiency.

Also, by the provision of the lower hole 10 and the lateral holes 5 in the same face, the machining cost can be further decreased because there is no need to change the position of the work piece during the hole-forming. Further, by the provision of the small hole 14, the lower hole 10 and the lateral holes 5 in the same face, the machining cost can be significantly reduced. Further, by making the lower hole and the small hole same diameter, the tool for use in the hole-forming can be used in common, thus decreasing the machining cost.

Of course, the lower hole 10 may be provided in the both sides of the outlet end portion of the expanded end portion 9.

Further, the outlet end portion of the expanded end portion 9 may be completely sealed so that no lower hole 10 is provided. In this case, the refrigerant liquid 7*a* overflows from the lateral hole 5 at the most downstream side and the separation efficiency decreases, but the machining cost can be reduced due to the eliminated machine of forming the lower hole 10.

Figure 10:
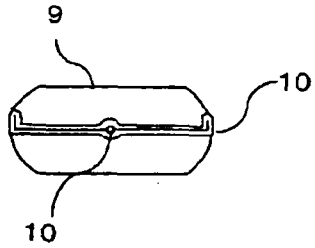
FIG. 10 is a bottom view of a modified example of the inlet pipe of the gas-liquid separator of the present invention. (Embodiment 1)

Further, as shown in FIG. 10, the lower side of the expanded end portion 9 may be bent, in which case the maximum value of the width d2 of the expanded end portion 9 is small, so that the insertion of the inlet pipe 2 into the vessel 1 is easy even when the upper opening of the vessel 1 is small and the interference between the expanded end portion 9 and the inner wall of the vessel 1 can be prevented.

Figure 11:
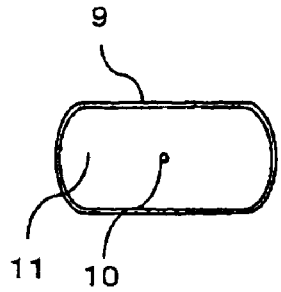
FIG. 11 is a bottom view of another modified example of the inlet pipe of the gas-liquid separator of the present invention. (Embodiment 1)

Also, as shown in FIG. 11, a bottom plate 11 having the lower hole 10 formed therein may be brazed to the bottom of the expanded end portion 9, in which case the lower hole 10 can be precisely formed and the separation efficiency can be improved. The bottom plate 11 may not have a lower hole to seal the bottom, and the expanded end portion 9 of the various cross-sectional configuration can be closed or provided with the small hole at the downstream side end portion by brazing the bottom plate 11.

Also, by installing the gas-liquid separator of embodiment 1 in a refrigeration cycle, the refrigerant vapor and the refrigerant liquid flowing in the gas-liquid two phase state can be separated so that the refrigerant liquid only is supplied to the evaporator, whereby the pressure loss of the refrigerant when passing through the evaporator can be decreased and the energy efficiency of the air conditioner can be improved.

Figure 25:
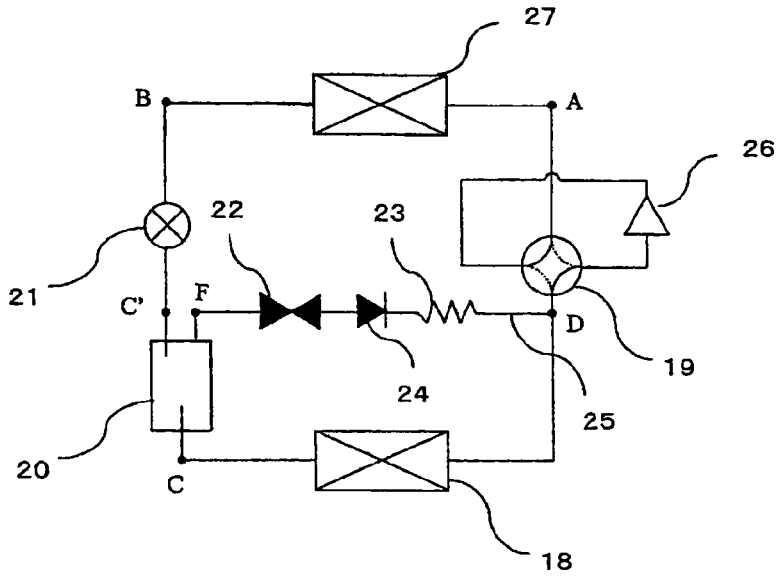
FIG. 25 is a refrigeration cycle diagram of the gas-liquid separator of the present invention according to embodiment 1 when it is installed in a refrigeration cycle. (Embodiment 1)
Figure 26:
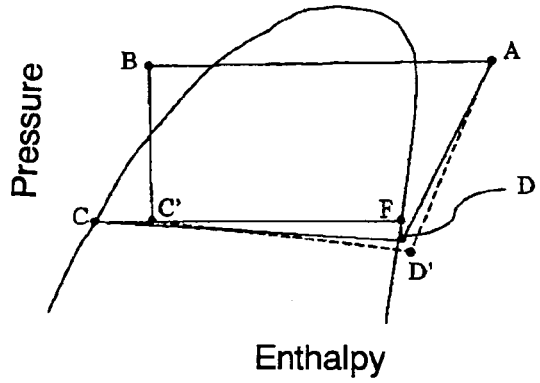
FIG. 26 is a graph showing the relationship between the pressure and the enthalpy of the refrigeration cycle when the gas-liquid separator according to embodiment 1 of the present invention is installed in a refrigeration cycle. (Embodiment 1)

The operation and the advantageous results when the gas-liquid separator as shown in embodiment 1 is installed in the refrigeration cycle will be explained in conjunction with the refrigeration cycle diagram shown in FIG. 25 and the relationship between the enthalpy and the pressure of the refrigeration cycle as shown in FIG. 26. Points A to F in FIG. 25 corresponds respectively to the points A to F in the refrigeration cycle of FIG. 26.

In the normal cooling operation in which the gas-liquid separation is not achieved, an electromagnetic valve 22 is closed so that the refrigerant is not supplied to a bypass circuit 25. The refrigerant that becomes high pressure (point A) by a compressor 26 is condensed (point B) in an outdoor heat exchanger 27. Thereafter, it is returned to the compressor 26 via a four-way valve 19 after depressurized (point C') by an expansion valve 21 and evaporated (point D') in an indoor heat exchanger 18.

On the other hand, when the gas-liquid separator of embodiment 1 is installed in the refrigeration cycle, the electromagnetic valve 22 is opened so that the refrigerant vapor is supplied to the bypass circuit 25. The refrigerant that becomes high pressure (point A) by the compressor 26 is condensed (point B) in the outdoor heat exchanger 27, depressurized (point C') by the expansion valve 21 and then separated between the refrigerant vapor and the refrigerant liquid by the gas-liquid separator 20. The refrigerant liquid (point C) is evaporated in the indoor heat exchanger 18, and the refrigerant vapor (point F) flows through the bypass circuit 25 composed of the electromagnetic valve 22, a check valve 24 and a capillary tube 23 to join with the refrigerant liquid at the point D. The joined refrigerant is returned to the compressor 26 via the four-way valve 19.

As understood from FIG. 26, when the gas-liquid separator of embodiment 1 is installed in the refrigeration cycle, the pressure loss upon the refrigerant passes through the evaporator (the pressure difference between point C and point D) can be made smaller than the pressure difference when the gas-liquid separator is not installed (the pressure difference between point C' and point D'). This causes the suction pressure of the compressor 26 to increase from point D' to point D, decreasing the machine necessary to compress the fluid from the suction pressure to the discharge pressure (point A), improving the energy efficiency of the air conditioner.

Embodiment 2

Figure 12:
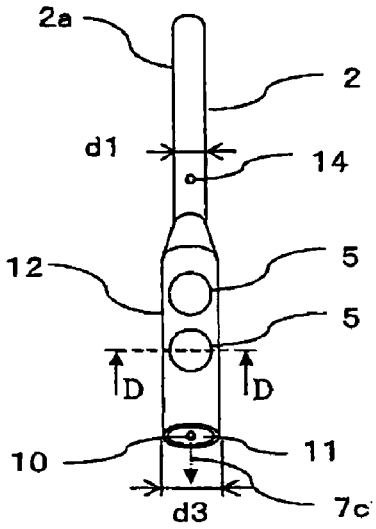
FIG. 12 is a side view of the inlet pipe of the gas-liquid separator of the present invention. (Embodiment 2)

Also, as shown in FIG. 12, the inlet pipe 2 may be expanded at the lower portion into a cylindrical configuration to provide an expanded end portion 12 and the lateral holes 5 are provided in the side face of the expanded end portion 12. In this example, the bottom plate 11 with the lower hole 10 is brazed at the lower portion of the expanded end portion 12. For example, the diameter d1 of the connecting pipe 2*a* is about 6 mm, the diameter of the expanded end portion 12 is about 13 mm, the width d2 of the expanded end portion 12 being about two times larger than the diameter d1 of the connecting pipe 2*a*. The diameter of the lateral holes 5 is about 6 mm and the diameter of the lower hole 10 is about 2 mm.

Figure 13:
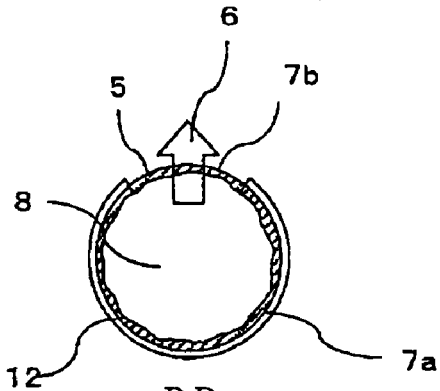
FIG. 13 is a sectional view taken along line D-D of FIG. 12 showing only the inlet pipe of the gas-liquid separator of FIG. 12. (Embodiment 2)

According to this arrangement, the width (diameter) d3 of the expanded end portion 12 is larger than the diameter d1 of the inlet pipe at the portion intersecting with the vessel of the gas-liquid separator, so that, as shown in FIG. 13, the thickness of the liquid film of the refrigerant liquid 7*a* and 7*b* flowing in the expanded end portion 12 is thin over the entire circumference, decreasing the amount of the refrigerant liquid 7*b* discharged from the lateral holes 5 together with the refrigerant vapor 8 and increasing the refrigerant liquid 7*c* discharged from the lower hole 10, whereby the refrigerant vapor 8 and the refrigerant liquid 7*c* can be efficiently separated at the expanded end portion 12, improving the separation efficiency.

Also, the expanding machining of the circular pipe is easy, so that the machining cost can be decreased.

Figure 14:
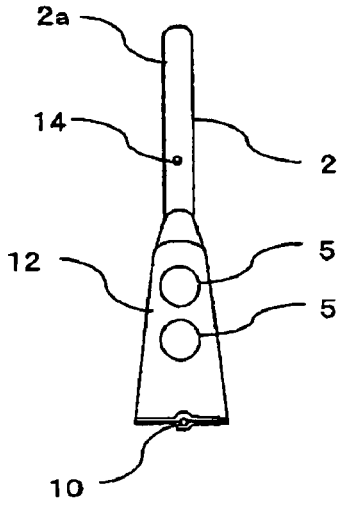
FIG. 14 is a side view showing a modified example of the inlet pipe of the gas-liquid separator of the present invention. (Embodiment 2)

While the bottom plate 11 having the lower hole 10 is brazed in the lower portion of the expanded end portion 12 in embodiment 2, the lower hole 10 may be provided by pressing the lower portion of the expanded end portion 12 as shown in FIG. 14. Also, the expanded end portion 12 may be a separate member brazed to the inlet pipe 2.

Figure 24:
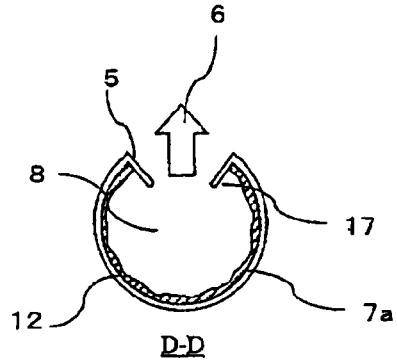
FIG. 24 is a sectional view showing a modified example of the gas-liquid separator of the present invention taken along the line D-D of FIG. 12. (Embodiment 5)

Further, as shown in the D-D section in FIG. 24, the lateral holes 5 may be formed with a rising portion 17 inside of the expanded end portion 12 such as by the burring operation. With this arrangement, the rising portion 17 impedes the flowing out of the refrigerant liquid 7*a* flowing along the wall surface of the inlet pipe 2 together with the refrigerant vapor 8, further improving the separation efficiency.

Figure 27:
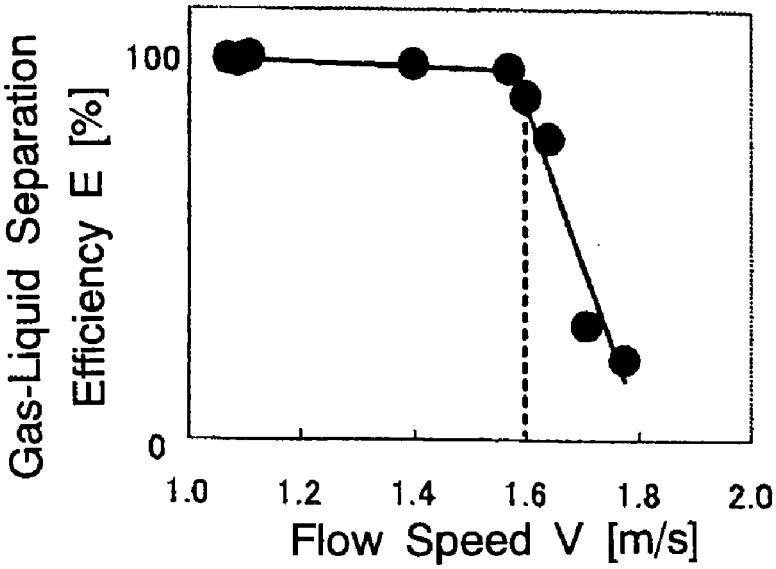
FIG. 27 is a graph showing the gas-liquid separation efficiency of the gas-liquid separator according to embodiment 2 of the present invention. (Embodiment 2)

Further, FIG. 27 illustrates the test results when the gas-liquid separator shown in embodiment 2 is used and the refrigerant flow rate W [kg/h] of the refrigerant flowing into the gas-liquid separator and the total area A [$m^2$] of the opening area of the lateral holes 5 are changed. The axis of abscissa designates the flow speed V [m/s] of the refrigerant vapor 8 discharged from the lateral holes 5 formed in the side face of the expanded end portion 9, and the axis of ordinate designates the gas-liquid separation efficiency E [%].

The speed V [m/s] of the refrigerant vapor 8 can be calculated by the equation (1) given below.

$$V=W/3600\times X/\rho g/A \quad (1)$$

Where, X is the degree of dryness [-], ρg is the density [$kg/m^3$] of the refrigerant vapor flowing into the gas-liquid separator, and the degree of dryness X is calculated by the equation (2).

$$X=(hin-hl)/(hg-hl) \quad (2)$$

Where, hin is the enthalpy [J/kg] of the refrigerant flowing into the gas-liquid separator, hg is the saturated vapor enthalpy [J/kg] of the refrigerator, and hl is the saturated liquid enthalpy [J/kg] of the refrigerant. The enthalpy, the density and the flow rate can be obtained by measuring the temperature, the pressure and the power of the refrigeration cycle in which the gas-liquid separator is installed.

Also, the gas-liquid separation efficiency [%] can be calculated by the equation (3) given below.

$$E=Wg1/Wg\times 100=Wg1/(W/X)\times 100 \quad (3)$$

Where, Wg1 is the maximum flow rate [kg/h] when only the refrigerant vapor flows out from the upper outlet pipe 3 of the gas-liquid separator, and Wg is the flow rate [kg/h] of the refrigerant vapor 8 flowing into the gas-liquid From FIG. 27, it is understood that the gas-liquid separation efficiency E increases as the flow speed V of the refrigerant vapor 8 discharged from the lateral holes 5 decreases from about 1.8 m/s to 1.6 m/s. It is also understood that, when the flow speed V of the refrigerant vapor discharged from the lateral holes 5 is equal to or less than 1.6 m/s, the gas-liquid separation efficiency E is kept at substantially constant at a high gas-liquid separation efficiency. This is because, while the refrigerant liquid 7*b* discharged from the lateral holes 5 together with the refrigerant vapor 8 impinges against the side wall 1*a* of the vessel 1 and attached thereto to become the refrigerant liquid 7*d*, when the flow speed V of the refrigerant vapor 8 discharged from the lateral holes 5 is greater than 1.6 m/s, the refrigerant liquid 7*d* attached to the side wall 1*a* of the vessel 1 is scattered by the action of the high speed refrigerant vapor 8 and flows out from the upper outlet pipe 3 together with the refrigerant vapor 8, thus degrading the gas-liquid separation efficiency E.

Therefore, by adjusting the flow rate W, the density ρg and the degree of dryness X of the refrigerant flowing into the gas-liquid separator and selecting the total area A of the opening area of the lateral holes 5 so that the flow speed V of the refrigerant vapor 8 discharged from the lateral holes 5 is equal to or less than 1.6 m/s, the scattering of the refrigerant liquid 7*d* attached to the side wall 1*a* of the vessel 1 can be suppressed, thereby maintaining a high gas-liquid separation efficiency.

Embodiment 3

Figure 15:
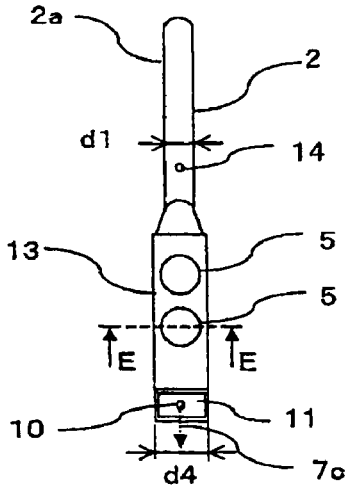
FIG. 15 is a side view showing the inlet pipe of the gas-liquid separator of the present invention. (Embodiment 3)

In the example illustrated in FIG. 15, the lower portion of the inlet pipe 2 is expanded into a rectangular parallelepiped configuration to provide an expanded end portion 13 having a cross section of a rectangular or square shape and the lateral holes 5 may be provided on the side face of the expanded end portion 13. In this example, the expanded end portion 13 has brazed at its lower end the bottom plate 11 with the lower hole 10.

Figure 16:
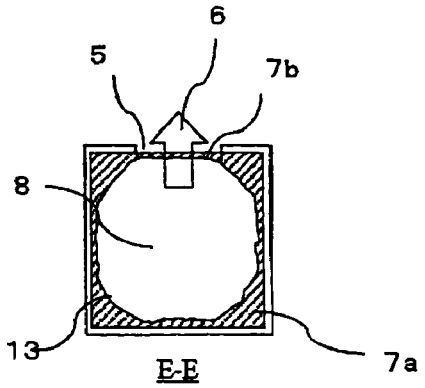
FIG. 16 is a sectional view taken along line E-E of FIG. 15 showing the inlet pipe of FIG. 15. (Embodiment 3)

According to this arrangement, the expanded end portion 13 has the width d4 of larger than the diameter d1 of the inlet pipe at the portion intersecting with the vessel 1 of the gas-liquid separator and has corners, so that, as shown in FIG. 16, at the square cross section of the expanded end portion 13, the liquid film of the refrigerant liquid 7*a* flowing in the vicinity of the corners is thick and the liquid film of the refrigerant liquid 7*b* flowing at the center of the sides is thin. Therefore, the amount of refrigerant liquid 7*b* discharged together with the refrigerant vapor 8 from the lateral holes 5 is decreased and the refrigerant liquid 7*c* discharged from the lower hole 10 is increased, the refrigerant vapor 8 and the refrigerant liquid 7*c* can be efficiently separated in the expanded end portion 13, improving the separation efficiency of the gas-liquid separator. It is preferable that the lateral holes 5 are disposed at the center of the sides because the liquid film of the refrigerant liquid 7*b* flowing in the center of the side is thinner.

While the bottom plate 11 having the lower hole 10 is brazed to the lower portion of the expanded end portion 13, the expanded end portion 13 may be pressed at the lower portion to form the lower hole 10. Also, the expanded end portion 13 may be a separate member brazed to the expanded end portion 13.

Also, while the cross section of the expanded end portion 13 is explained as being a square, as long as the width (maximum width) d4 of the expanded end portion 13 is larger than the diameter d1 of the inlet pipe at the portion intersecting the vessel of the gas-liquid separator, the cross-sectional shape of the expanded end portion 13 may equally be rectangular, rhombic, parallelogram, trapezoidal, polygon and the like.

Also, while two lateral holes 5 are provide in the example, one or more holes may equally be provided and the diameter of the lateral hole may be discretionary.

Figure 17:
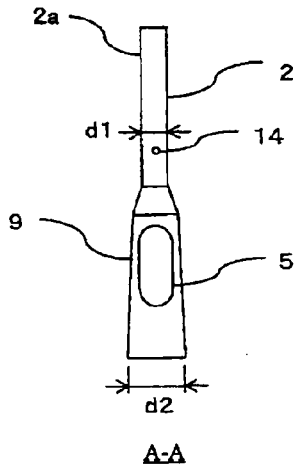
FIG. 17 is a side view showing a modified example of the inlet pipe of the gas-liquid separator of the present invention. (Embodiment 3)

Also, as shown in FIG. 17, the lateral hole 5 may be vertically elongated, whereby the machining cost can be further reduced.

Also, while the lower hole 10 is disposed in the lower portion of the inlet pipe, it is suitable as long as the lower hole 10 has a sufficiently small opening area to prevent the refrigerant vapor 8 from discharging from the lower hole 10 and is disposed at a position downstream of the lateral hole 5.

Also, the bottom face of the expanded end portion 9 may be completely closed and no lower hole 10 may be provided, in which case the machining cost can be reduced although the refrigerant liquid 7*a* over flows from the lower post lateral holes 5 and the separation effect is decreased.

Also, by disposing the expanded end portion 13 lower than the insertion length L1 of the outlet pipe 3, the expanded end portion 13 does not interfere with the outlet pipe 3, so that the width d4 of the expanded end portion 13 can be made larger, enabling the further improvement in the separation efficiency.

Embodiment 4

Figure 18:
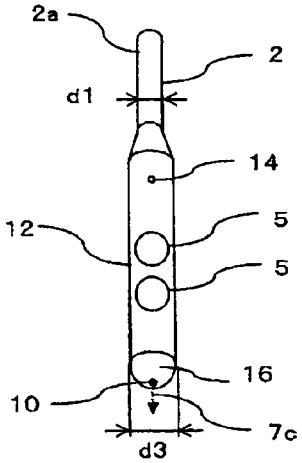
FIG. 18 is a side view showing the inlet pipe of the gas-liquid separator of the embodiment 4 of the present invention. (Embodiment 4)

Also, as shown in FIG. 18, the lower portion of the expanded end portion 12 may be squeezed and closed by the closing deformation 16 and then provided with the lower hole 10 by the hole forming. In the closing deforming 16, there is no need to braze the bottom plate 11, so that the machining cost can be significantly reduced.

Figure 19:
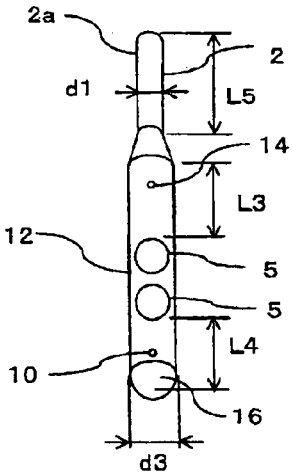
FIG. 19 is a side view showing the inlet pipe of the gas-liquid separator of the present invention. (Embodiment 4)

Further, as shown in FIG. 19, the lower portion of the expanded end portion 12 may be closed by the closing deformation 16 and the lower hole 10 may be hole-machined in the side face of the expanded end portion 12 so that it is on the same face as the lateral holes 5, whereby the need for changing the position of the work piece is eliminated and the machining cost can be further reduced.

Also, the small hole 14 may be hole-formed in the side face of the expanded end portion 12 in the same face as that of the lateral holes 5 and the diameters of the small hole 14 and the lower hole 10 may be made common, whereby the machining cost can be significantly reduced.

Also, by extending the distance L3 from the upstream end portion of the expanded end portion 12 to the lateral hole in the most upstream side position, the disturbance of the refrigerant due to the diameter expansion of the inlet pipe 2 from d1 to d3 can be made more stable, so that the refrigerant liquid discharged from the lateral holes 5 is more stable and the separation efficiency can be improved. Further, by extending the distance L3, the distance L5 in which the blank pipe must be squeezed from d3 to d1 when the diameter of the pipe is d3 can be made small, so that the machining cost needed for squeezing can be decreased.

Also, by extending the distance L4 from the lateral hole 5 at the most down stream position to the downstream end portion of the expanded end portion 12, a large amount of the refrigerant liquid 7*a* can be accumulated in the lower portion of the expanded end portion 12, so that, even when the amount of the refrigerant flowing into the inlet pipe 2 is increased, the amount of the refrigerant liquid 7*a* over flowed from the lateral holes 5 can be made small, thus improving the separation efficiency.

Also, the diameter of the expanded end portion 12 is discretionary and may be an oval shape as long as the width d3 of the expanded end portion 12 is larger than the diameter d1 of the inlet pipe at the portion intersecting with the vessel 1 of the gas-liquid separator.

Figure 20:
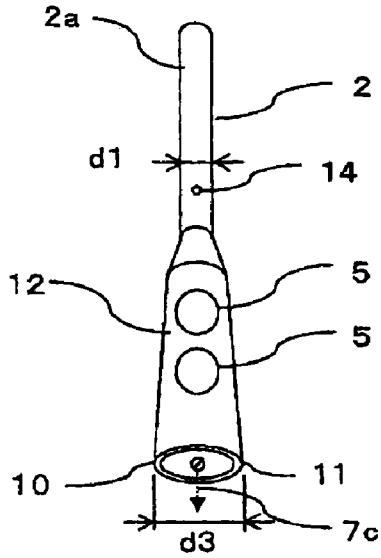
FIG. 20 is a side view showing another modified example of the inlet pipe of the gas-liquid separator of the present invention. (Embodiment 4)

Also, as shown in FIG. 20, the diameter of the expanded end portion 12 may be made larger toward the down stream.

In this case, a large amount of the refrigerant liquid 7*a* can be accumulated in the lower portion of the expanded end portion 12, even, when the amount of refrigerant liquid flowing into the inlet pipe 2 increases, the amount of the refrigerant liquid 7*a* over flowing from the lateral holes 5 can be limited, thus improving the separation efficiency.

Also, while two lateral holes 5 are shown in the example, it is suitable as long as one or more lateral holes 5 is provided and the diameter of the lateral holes is discretionary.

Also, it is suitable as long as the opening area of the lower hole 10 is small enough to prevent the refrigerant vapor 8 from discharging from the lower hole 10 and the lower hole 10 is disposed down stream of the lateral holes 5.

Also, the lower surface of the expanded end portion 9 may be completely closed and the lower hole 10 may not be provided, in which case the machining of the lower hole can be omitted and the machining cost can be reduced while the refrigerant liquid 7*a* overflows from the lateral hole in the lowermost position and the separation effect is degraded.

Also, as for the expanded end portion 12, the expanded end portion 12 may be disposed at a position lower than the insertion length L1 (shown in FIG. 6) of the outlet pipe 3, whereby the outlet pipe 3 and the expanded end portion 12 do not interfere with each other and the width d3 of the expanded end portion 12 can be larger.

Embodiment 5

Figure 21:
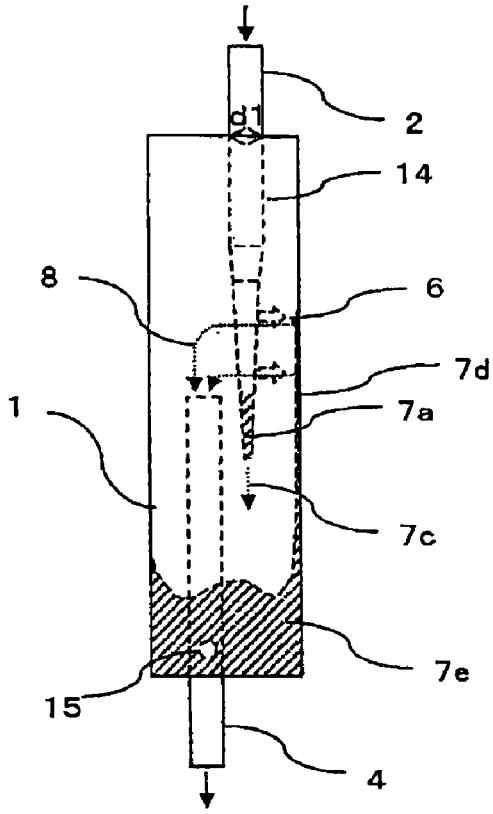
FIG. 21 is a front view showing a gas-liquid separator of embodiment 5 of the present invention. (Embodiment 5)

When used as an accumulator, the upper outlet pipe 3 may not be provided and only the lower outlet pipe 4 may be provided as shown in FIG. 21. In this arrangement, by the provision of a small hole 15 in the side face of the lower outlet pipe 4 at a position close to the bottom of the vessel 1, the refrigerator oil dissolved in the refrigerant liquid can be returned to the compressor little by little together with the refrigerant liquid, so that the lubrication of the compressor can be improved. Further, when the refrigerator oil is not soluble to the refrigerant, the refrigerator oil stays on the refrigerant, so that the position of the small hole 15 is determined according to the position in which the refrigerator oil stays, whereby the refrigerator oil can efficiently be returned to the compressor.

Figure 22:
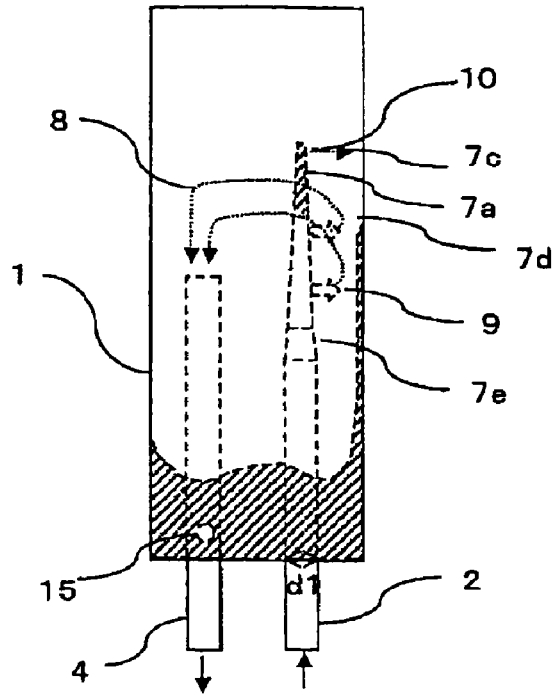
FIG. 22 is a front view showing a modified example of the gas-liquid separator of the present invention. (Embodiment 5)

Also, as shown in FIG. 22, the inlet pipe 2 may be disposed in the lower portion of the vessel 1. In this case, due to the effect of the gravity, the amount of refrigerant liquid 7*a* accumulated in the expanded end portion 9 of the inlet pipe 2 is decreased, the gas-liquid separation is possible due to the inertia. In this arrangement, the inlet pipe 2 and the outlet pipe 4 are mounted only on one side of the vessel 1, so that the machining cost can be decreased. Further, even when the pipes can be mounted only in the lower portion of the vessel 1 due to the arrangement of other components of the refrigeration cycle, the degree of the design freedom can be enlarged. Also, since the lower hole 10 is in the upper portion of the inlet pipe 2, the lower hole 10 can assist the function of the small hole 14, thereby reducing the machining cost.

Figure 23:
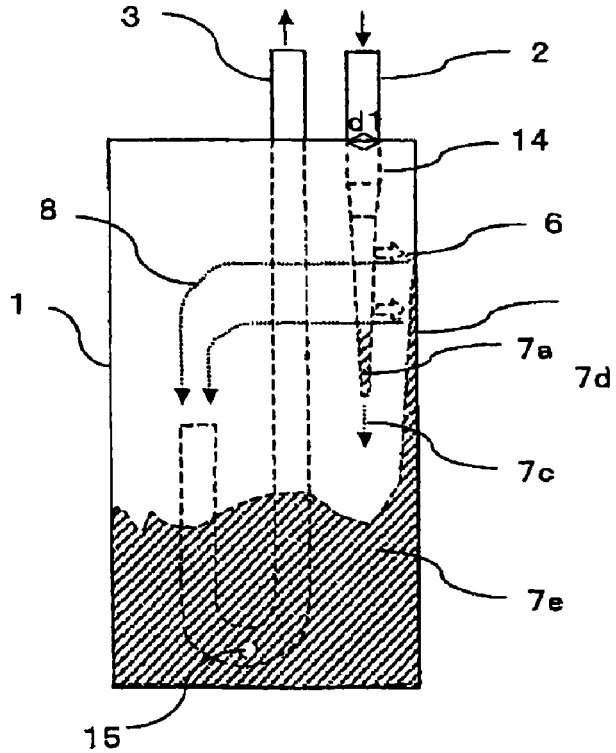
FIG. 23 is a front view showing another modified example of the gas-liquid separator of the present invention. (Embodiment 5)

Further, as shown in FIG. 23, the lower outlet pipe 4 may be eliminated and the inlet pipe 2 and the upper outlet pipe 3 may be disposed only in the upper portion of the vessel 1. In this arrangement, by bending the upper outlet pipe 3 into a U-shape within the vessel and providing the small hole 15 in the side face of the upper outlet pipe 3 positioned close to the bottom of the vessel 1, the oil dissolved in the refrigerant liquid can be returned to the compressor little by little together with the refrigerant liquid, thereby improving the lubrication of the compressor.

As has been described, the gas-liquid separator of the present invention comprises a vessel for achieving the gas-liquid separation of a gas-liquid mixture fluid, an inlet pipe including a connecting pipe penetrating and extending into the vessel and an expanded end portion connected to an inner end of the connecting pipe for changing the flow direction of the gas-liquid mixture fluid, and an outlet pipe penetrating and extending to the vessel, the expanded end portion having an expanded end portion width dimension larger than the diameter of the connecting pipe, and the expanded end portion 9 being provided at its side face with a lateral hole 5.

When the gas-liquid separator shown in the above-described embodiments is installed in the refrigeration cycle using an ejector, the air conditioner can be made compact and the energy efficiency can be improved.

Also, the gas-liquid separator shown in the above-described embodiments may be disposed at a downstream side of the compressor and used as an oil separator for separating the refrigerator oil flowed out from the compressor into the refrigeration cycle from the refrigerant vapor to return the refrigerator oil to the compressor. This enables the lubrication of the compressor to be improved and the amount of the refrigerator oil flowing out into the refrigeration cycle and entrained in the refrigerant to be decreased, so that the heat transfer performance of the evaporator and the condenser is improved and the energy efficiency of the air conditioner can be improved.

Also, the gas-liquid separator shown in the above-described embodiments may be disposed on the suction side of the compressor to use is as an accumulator for separating the refrigerant liquid failed to be evaporated in the evaporator from the refrigerant vapor to return only the refrigerant vapor to the compressor. This enables the prevention of the compressor from compressing the liquid and being damaged.

The invention claimed is:

1. A gas-liquid separator comprising:

a vessel;

an inlet pipe penetrating into said vessel; and an outlet pipe connected to said vessel, wherein an exit end portion of said inlet pipe is formed to be closed or to have a gap, the portion of said inlet pipe that is penetrated into said vessel is expanded in one direction perpendicular to the length of the inlet pipe, to provide a side face with a width in said one direction that is greater than the diameter of that portion of said inlet pipe, along the direction of the length of the inlet pipe, where the inlet pipe first enters the vessel of the gas-liquid separator, and wherein a first lateral hole is formed in said side face.

2. A gas-liquid separator as claimed in claim 1, wherein a second lateral hole is provided in said side face at a location closer to an end of said inlet pipe in said vessel than is said first lateral hole.

3. A gas-liquid separator as claimed in claim 1, wherein a further hole, which is smaller than said first lateral hole, is provided in said inlet pipe at a location farther from an end of said inlet pipe in said vessel than is said first lateral hole.

4. A gas-liquid separator as claimed in claim 1, wherein said first lateral hole is disposed so that the flow direction of the fluid from said first lateral hole is substantially perpendicular to a side wall of said vessel.

5. A gas-liquid separator as claimed in claim 1, wherein said first lateral hole is sized such that a flow speed of the fluid discharged from said first lateral hole is equal to or less than 1.6 m/s.

6. A gas-liquid separator as claimed in claim 1, wherein the cross-sectional shape of said expanded portion is an elongated shape or an oval shape.

7. A gas-liquid separator as claimed in claim 1, wherein the cross-sectional shape of said expanded portion is a circular shape.

8. A gas-liquid separator as claimed in claim 1, wherein the cross-sectional shape of said expanded portion is a polygonal shape.

9. A gas-liquid separator as claimed in claim 1, wherein said first lateral hole is provided with a flange rising inside of said expanded portion.

10. An air conditioner having installed a gas-liquid separator as claimed in claim 1.

11. A gas-liquid separator as claimed in claim 1, wherein the portion of said inlet pipe that is penetrated into said vessel has a width, in another direction perpendicular to the length of the inlet pipe, and also perpendicular to the one direction, that is less than the width of the side face in the one direction.

12. A gas-liquid separator as claimed in claim 11, wherein an exit end portion of said inlet pipe is formed to be closed.

13. A gas-liquid separator as claimed in claim 11, wherein an exit end portion of said inlet pipe is formed to have an opening.

14. A gas-liquid separator as claimed in claim 1, wherein an exit end portion of said inlet pipe is formed to be closed.

15. A gas-liquid separator as claimed in claim 1, wherein an exit end portion of said inlet pipe is formed to have an opening.

* * * * *